United States Patent [19]

Dobryakov et al.

[11] Patent Number: 4,871,448

[45] Date of Patent: Oct. 3, 1989

[54] MECHANICAL FLOTATION MACHINE

[75] Inventors: Valentin I. Dobryakov, Leningrad; Galina V. Zhevzhik, Soligorsk; Valery A. Seballo; Evgeny V. Zhukov, both of Leningrad; Altar Z. Ententeev, Berezniki; Vyacheslav N. Struzhkov, Moscow; Alexandr S. Gorbachev, Soligorsk, all of U.S.S.R.

[73] Assignee: Gosudarstvenny Proektno-Konstruktorsky I Experimentalny Institut Po Obogatitelnomu Oborudovaniju, Leningrad, U.S.S.R.

[21] Appl. No.: 206,379

[22] Filed: Jun. 14, 1988

[51] Int. Cl.[4] ..... B03D 1/20

[52] U.S. Cl. ..... 209/169; 261/87; 366/102; 366/339; 366/270

[58] Field of Search ..... 209/169, 170; 261/87; 210/219, 221.2; 366/102, 107, 302, 307, 339, 270

[56] References Cited

U.S. PATENT DOCUMENTS

| | | | |
|---|---|---|---|
| 1,326,453 | 12/1919 | Jones | 209/169 |
| 1,921,220 | 8/1933 | Daman | 209/169 |
| 2,433,592 | 12/1947 | Booth | 209/169 |
| 2,792,939 | 5/1957 | Myers | 209/169 |
| 3,972,815 | 8/1976 | O'Chesky | 209/169 |

FOREIGN PATENT DOCUMENTS

| | | | |
|---|---|---|---|
| 963503 | 7/1964 | United Kingdom | 209/169 |
| 2106806 | 4/1983 | United Kingdom | 209/169 |

*Primary Examiner*—David L. Lacey
*Assistant Examiner*—Thomas M. Lithgow
*Attorney, Agent, or Firm*—Fleit, Jacobson, Cohn, Price, Holman & Stern

[57] ABSTRACT

A mechanical flotation machine comprises a flotation cell, a circulating pipe vertically installed therein, an axial impeller mounted in the lower portion of the pipe and a guide device secured to the lower end of the pipe. The guide device has an annular gap through which pulp flow generated by the impeller returns from the cell to the pipe. Vanes are installed in the annular gap to create, above the impeller, pulp flow rotating opposite to the rotation of the impeller.

4 Claims, 2 Drawing Sheets

MECHANICAL FLOTATION MACHINE

FIELD OF THE INVENTION

The present invention relates to apparatus for extracting particulate solids from pulp and more particularly, to mechanical flotation machines. The invention can be used in mineral separation assemblies and sewage works.

BACKGROUND OF THE INVENTION

Separation of solid materials in mechanical flotation machines is effected by agitation of a pulp containing a material to be floated using an impeller installed in a flotation cell into which the pulp is fed. Agitation aerates the pulp thus dispersing the air contained in the pulp with the result that air bubbles develop to which particles of the material being separated (floated) stick. These particles rise, together with the air bubbles, to the pulp surface to form a froth product having a higher concentration of the floatable material as compared to the starting product. The froth product is fed through an overflow lip of the flotation cell to further treatment.

A prior art flotation machine (US, A, 3393802) comprises a flotation cell adapted for receiving a pulp containing a material to be floated and having in its upper portion an overflow lip to carry off the froth product therethrough, a circulating pipe vertically installed in the cell and having its lower end disposed in the lower portion of the cell, an impeller of the centrifugal type installed between the lower end of the circulating pipe and the cell bottom so as to permit rotation about the vertical axis, with the impeller inlet side facing the lower end of the circulating pipe, for the pulp to move from the interior of the circulating pipe to the space at the outlet side of the impeller, openings disposed in the wall of the circulating pipe in the upper portion of the flotation cell and communicating the interior of the circulating pipe with its environment in the cell and thus with the space at the outlet side of the impeller, and an impeller drive means connected to the impeller through a hollow shaft. The centrifugal impeller is constituted by a horizontally disposed disc with blades in radial arrangement on its top. The impeller is enclosed by a stator constituted by a fixed horizontal ring attached to the lower end of the circulating pipe and by vanes radially arranged around the impeller near the edges of its blades and attached to the outer lateral surface of the ring.

As the impeller rotates, the pulp from the interior of the circulating pipe is passed into the region between the radial blades of the impeller and, by the centrifugal action, discharged from the impeller outlet side through the annular gap between the impeller disc and stator into the lower portion of the flotation cell. The pulp is passed through the openings in the walls of the circulating pipe in the upper portion of the cell back into the circulating pipe. Air is supplied under pressure to the pulp from an external source through the hollow shaft of the impeller. Air dispersion occurs as the pulp and air flow round both impeller blades and stator vanes.

With this design of a flotation machine, pulp is agitated with approximately equal intensity throughout the whole volume of the flotation cell, i.e. in the bottom portion of the flotation cell (agitation zone) as well as in its remaining portion (flotation zone). Intense agitation of the pulp in the flotation zone renders the solid particles of the material being floated more apt to tear off from air bubbles, which impairs the outlet of the flotation machine; on the other hand, intense agitation of the pulp in the flotation zone causes materials contained in the pulp that are not intended to be floated, such as gangue, to go to the pulp surface, which impairs the quality of the concentrate obtained, i.e. lowers the content of the material separated.

Agitation of the pulp in the flotation zone in such a machine requires additional power. It is also known that impellers of the centrifugal type are of relatively low efficiency.

The rotational speed of a centrifugal impeller is limited by cavitation. Also, increase in the rotational speed of the impeller results in a cone of influence rotating in the same direction as the impeller, which breaks the flow and brings to an end the agitation of pulp in the agitation zone. This necessitates the use of a reduction gear to transmit the rotation of a motor with relatively high rotational speed to the shaft of a centrifugal impeller with relatively low rotational speed, which increases the metal input per structure. Decrease in the rotational speed of the impeller also decreases the number of air bubbles formed by air dispersion at the impeller outlet, which is caused by a decreased number of collisions between pulp and impeller blades or stator vanes, thus lowering the machine efficiency.

The use of an external source for forces aeration of pulp involves additional equipment and increases power consumption.

Also known in the prior art is a flotation machine (N.F. Mescheriakov, "Flotatsionnye Mashiny i Apparaty," 1982, Nedra (Moscow), pp. 97–103) comprising a flotation cell adapted for receiving a pulp containing a matter to be floated and having in its upper portion an overflow lip to carry off the froth product therethrough, a circulating pipe mounted in the cell and passing from top to bottom so that its lower end is disposed in the lower portion of the flotation cell, an impeller of the centrifugal type rotatably mounted above the vertical axis between the lower end of the circulating pipe and the bottom of the flotation cell, with its inlet side facing the lower end of the circulating pipe, to permit pulp movement from the interior of the circulating pipe to the space at the outlet side of the impeller, and an impeller drive means. In this machine, the space at the outlet side of the impeller communicates with the interior of the circulating pipe through its open end disposed in the upper portion of the flotation cell below the overflow lip. Horizontally mounted within the flotation cell is a grid separating the upper portion from the lower portion of the cell. Air supply is effected by suction from atmosphere as a result of rarefaction in the circulating pipe due to rotation of the impeller, which eliminates the need of a separate source for compressed air supply. The centrifugal impeller is similar in design to that of the aforementioned U.S. Pat.

In operation of such an apparatus, a fluidized bed of solid particles contained in the pulp is formed on the surface of the grid at the lower side thereof as a result of the impeller's feeding continuously aerated pulp flow, said particles being captured by air bubbles in the aerated pulp and going up.

The grid makes it possible to separate the agitation zone and flotation zone of the flotation cell, thus decreasing the agitation intensity in the agitation zone. This makes it possible, on the one hand, to lower the probability for the solid particles of a material being separated to be torn off from air bubbles in the flotation zone, thus raising the machine efficiency, and, on the other hand, to decrease the amount of materials which are not intended to be floated but rise to the pulp surface, thus improving the quality of the concentrate obtained as compared to the apparatus of the afore-mentioned U.S. Pat.

However, sufficiently intense agitation of pulp particles on the grid surface is required to attain reasonable output, which results in considerable turbulence of pulp flows maintained in the flotation zone and impairs the concentrate quality and machine output and increases power consumption as indicated above.

The use of a centrifugal impeller results in high consumption of power and metal due to the use of a reduction gear and impairs air dispersion. Also, in such a flotation machine, additional power is required to overcome the resistance offered by the grid to the flow of pulp passing therethrough as well as to create above the impeller a rarefaction zone for air suction from atmosphere.

Moreover, the metal grid of considerable size and weight further increases the metal input of the machine.

Summary of the Invention

It is an object of the present invention to provide a mechanical flotation machine having high output.

Another object of the invention is to provide a mechanical flotation machine ensuring a high-quality concentrate.

Still another object of the present invention is to provide a mechanical flotation machine consuming less power in operation.

Yet another object of the invention is to lower the material input required for manufacturing a mechanical flotation machine, while improving its performance-to-cost ratio.

A further object of the present invention is to provide a mechanical flotation machine ensuring lower turbulence in the flotation zone, while providing intense agitation in the agitation zone of the flotation cell.

Still another object of the present invention is to provide a mechanical flotation machine with an impeller having a relatively high efficiency.

Another object of the present invention is to provide a mechanical flotation machine with an impeller ensuring more efficient dispersion of the air fed into the flotation zone of the machine.

Still another object of the invention is to provide a mechanical flotation machine effecting aeration of pulp without air suction or forced air supply from a separate source.

Yet another object of the present invention is to provide a mechanical flotation machine with an impeller which does not require a reduction gear.

With these and other objects in view, there is provided a mechanical flotation machine comprising a flotation cell adapted for receiving a pulp containing a material to be floated and having in its upper portion an overflow lip to carry off therethrough the product formed as a result of the flotation process. A circulating pipe installed in the flotation cell passes from its top to bottom so that the pipe lower end is disposed in the lower portion of the flotation cell and the pipe upper end, above the overflow lip of the flotation cell. An impeller is installed between the lower end of the circulating pipe and the bottom of the flotation cell so as to permit rotation about the vertical axis, with the impeller inlet side facing the lower end of the circulating pipe, for the pulp to move from the interior of the circulating pipe to the space at the outlet side of the impeller. The flotation machine is further provided with a means communicating the space at the outlet side of the impeller with the interior of the circulating pipe, and an impeller drive means. As distinguished from the prior art designs, the impeller of the flotation machine of the present invention is built as an axial impeller having radial blades inclined to the axis of rotation in the same direction and the means communicating the space at the outlet side of the impeller with the interior of the circulating pipe comprises an inner and an outer hollow cylinders, the outer hollow cylinder being attached to the lower end of the circulating pipe and enclosing the inner hollow cylinder, and the inner hollow cylinder, in turn, enclosing the impeller. Mounted in the annular gap between the hollow cylinders are radial vanes tangentially inclined to the axis of rotation of the impeller in the direction opposite to the slope of the impeller blades so as to direct the pulp flow from below the impeller to the interior of the circulating pipe in the direction opposite to the direction of rotation of the impeller.

The use of an axial impeller known to be more efficient than impellers of the centrifugal type in the conditions of relatively small resistance offered by the flow moved by the impeller (this is the case in the flotation machine) makes it possible to lower the power consumed by the flotation machine.

Impeller rotation gives rise to a descending axial current of pulp. This results in the pressure differential between the impeller suction region, i.e. the space at the inlet side of the impeller, and the forced region, i.e. the space at the outlet side of the impeller. Thanks to said pressure differential, the greater part of the axial flow from below the impeller returns to the circulating pipe through the annular gap between the outer and inner cylinders subsequent to agitation of pulp in the agitation zone. The radial vanes installed in said annular gap direct the returning pulp flow opposite to the direction of rotation of the impeller blades, which prevents the pulp flow from being broken at the impeller inlet. Since a return pulp current is formed in the agitation zone of the flotation machine, the turbulence of ascending pulp current drastically decreases, which results in an improved concentrate quality and increases its output. Additionally, the impeller drive power is hardly expended to agitate the pulp in the flotation zone of the machine or overcome the resistance offered by the grid separating the agitation and flotation zones, which lowers the power requirements of the machine.

The employment of an impeller of the axial rather than centrifugal type makes it possible to use an impeller of a relatively small diameter, however, rotating at a relatively high speed since even a high rotational speed of an axial impeller does not cause cavitation on its blades. A break in flow occasioned by increase in the rotational speed of the impeller in the prior art flotation machines is here precluded by a counterstream cone as indicated above.

Increase in the rotational speed of the impeller eliminates the need of a reduction gear to transmit the rotation of the motor to the impeller shaft, thus decreasing the amount of metal required to build a flotation machine, which is due to the absence of a grid separating the agitation and flotation zones in the cell of the flotation machine. Additionally, a high-speed impeller disperses the air more efficiently, thus raising the machine output.

A counterstream cone formed in the circulating pipe above the impeller has a large surface area, which provides for good aeration of pulp by the air entrapped by the rotating cone surface. This lowers power requirements for pulp aeration in operation of a flotation machine of this design which does not call for rarefaction above the impeller for air suction. No additional equipment for forced aeration of pulp is here required, either.

In the mechanical flotation machine according to the present invention, the space at the outlet side of the impeller may additionally communicate with the inside of the circulating pipe through holes provided in the side wall of the circulating pipe and furnished with baffles mounted above the holes inside the circulating pipe so that pulp filaments flowing out of said holes fall on the surface of the pulp rotating in the circulating pipe, which results in better entrapment of the air by the pulp surface and thus in more efficient aeration of the pulp. The baffles may be directed opposite to the slope of the impeller blades with the aim to use the kinetic energy of falling current filaments for rotating the cone formed in the circulating pipe. This lowers somewhat the power consumed in operation. If required, the flotation machine may be equipped with a separate means for forced air supply in the form of a hollow torus installed below the impeller and fastened to the lower end of the hollow cylinder, with its axis coinciding with the axis of rotation of the impeller. Provided on the inner surface of the hollow torus are slots inclined tangentially to said axis of rotation of the impeller in the direction opposite to the slope of the impeller blades. Compressed air from an external source is fed under pressure into the inside of the hollow torus and enters through the slots the region below the impeller, thus aerating additionally the pulp.

The afore-mentioned and other objects as well as the advantages of the invention will be more evident from the following detailed description of a preferred embodiment taken in conjunction with the accompanying drawings, wherein:

DESCRIPTION OF A PREFERRED EMBODIMENT OF THE INVENTION

Figure 1:
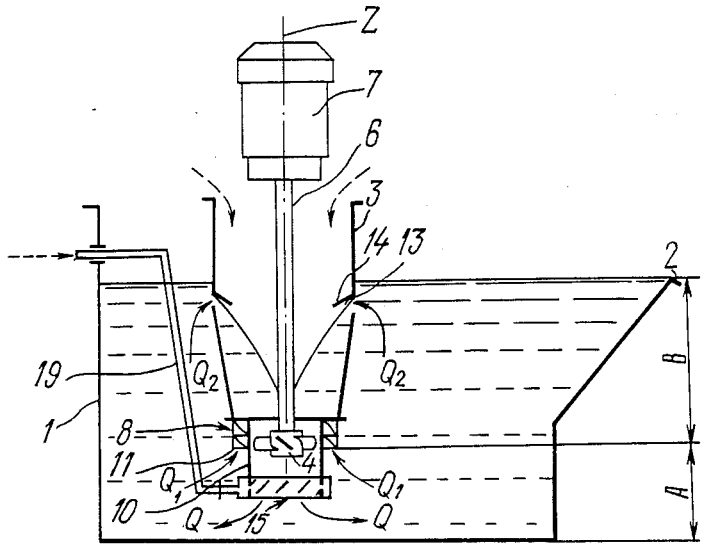
FIG. 1 represents schematically a sectional view of a mechanical flotation machine, according to the invention.

Referring now to FIG. 1, a mechanical flotation machine comprises a flotation cell 1 with an overflow lip 2, a vertically arranged circulating pipe 3 vertically installed in the cell 1, and an axial impeller 4 provided with blades 5 in radial arrangement. The impeller 4 is installed so as to permit rotation about the vertical Z-axis between the lower end of the circulating pipe 3 and the bottom of the flotation cell 1 and secured on a shaft 6 connected, e.g. using a coupling (not shown), to the shaft of an electric motor 7, with the upper inlet side of the impeller 4 facing the lower end of the circulating pipe. The blades 5 of the impeller 4 are tangentially inclined in the same direction to and extend radially inwardly from outer points toward the Z-axis of rotation, so that the lower edge of each of the blades 5 is shifted in the tangential direction with respect to its upper edge in a clockwise direction when viewed from the blade lower edges. As is most readily apparent from FIG. 2, blades 5 are inclined with respect to a plane in which the blades rotate.

Figure 2:
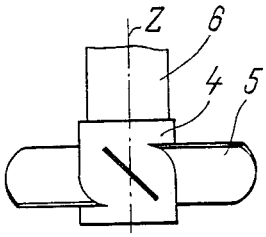
FIG. 2 represents an enlarged view of an impeller of a flotation machine according to the invention.
Figure 3:
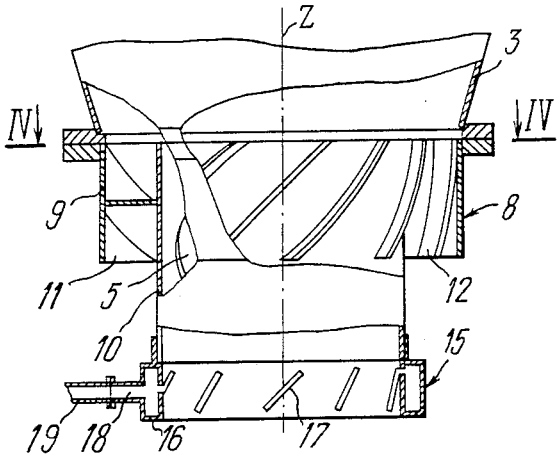
FIG. 3 represents an enlarged sectional view of a guide means and a means for forced air supply of the machine of FIG. 1.
Figure 4:
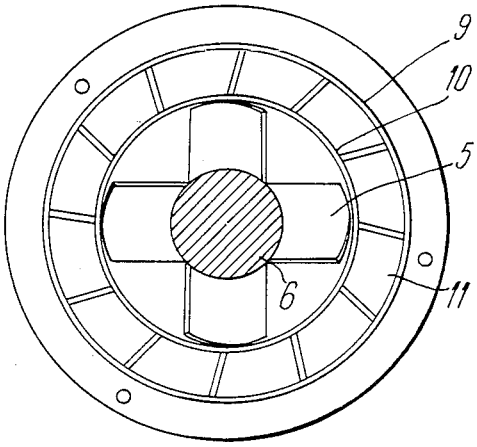
FIG. 4 represents a sectional view taken along the line IV—IV of FIG. 3.

The space at the opposite (outlet) side of the impeller 4 (FIG. 1) communicates with the interior of the circulating pipe 3 through a guide means 8 shown in more detail in FIGS. 2 and 3. The guide means 8 is made in a form of an outer an an inner hollow cylinders 9 and 10, respectively, the outer hollow cylinder 9 being installed below the lower end of the circulating pipe 3 and secured thereto, for example, by a flange joint, and the inner hollow cylinder 10 being installed inside, i.e., concentrically located radially inward of the outer hollow cylinder 9 to enclose the impeller 4. Radially arranged in an annular gap 11 formed between the cylinders are vanes 12 inclined tangentially to the Z-axis of rotation of the impeller so that the lower edge of each of the vanes 12 is shifted with respect to its upper edge in a counter-clockwise direction when viewed from the vane lower edges, i.e. in the direction opposite to the slope of the impeller blades 5 (FIG. 2). The space at the outlet side of the impeller 4 (FIG. 1) additionally communicates with the interior of the circulating pipe 3 through holes 13 provided in the side wall of the circulating pipe 3 and furnished with baffles 14 mounted above said holes inside the circulating pipe 3. The baffles 14 are inclined tangentially to the axis of rotation of the impeller 4 in the direction opposite to the slope of the blades 5 of the impeller 4.

Arranged underneath the impeller 4 is a means for forced air supply (sparger) 15 (FIG. 3) comprising a hollow torus 16 installed so that its axis coincides with the Z-axis of rotation of the impeller 4. The hollow torus 16 is provided with slots 17 made in its inner surface and tangentially inclined to the Z-axis of rotation of the impeller 4 in the direction of the slope of the vanes 12 of the guide means 8, i.e. in the direction opposite to the slope of the impeller blades 5. The sparger 15 is secured, for example, by welding to the lower end of the inner hollow cylinder 10. The sparger 15 (FIG. 3) also comprises a connection 18 communicating the inside of the hollow torus 16 with an external source of compressed air (not shown) through a pipe 19 (FIG. 1) one end of which is connected to the connection 18 (FIG. 2) and the other goes beyond the flotation cell 1 and is connected to the source of compressed air.

The mechanical flotation machine operates as follows. A pulp containing a material to be floated is fed into the lower portion of the flotation cell 1 and fills it up to the overflow lip 2. Upon switching on the electric motor 7, the impeller 4 is driven through the shaft 6 and rotates about the Z-axis in the direction of the slope to this axis of the upper edges of the blades 5 while carrying along the pulp contained in the circulating pipe 3. In this process, the pulp forms a descending axial stream Q moving along the Z-axis towards the bottom of the flotation cell 1 inside the cylinder 10 of the guide means 8 and then spreading over the bottom of the cell 1 and agitating the pulp which passes along the bottom. The stream is further divided into two components, $Q_1$ and $Q_2$. The streams Q, $Q_1$ and $Q_2$ are shown by solid arrows in FIG. 1.

Under the action of the pressure differential between the suction region and the pressure region of the impeller 4 arising from the passage of the stream Q, the stream $Q_1$ returns to the circulating pipe 3 thorugh the annular gap 11 between the inner cylinder 10 and the outer cylinder 9 of the guide means 8. Due to the slope of the vanes 12 in the direction opposite to that of the blades 5 of the impeller 4, the stream $Q_1$ returning to the circulating pipe 3 assumes, as it leaves the annular gap 11, the direction of motion whereby the horizontal component of this stream is directed opposite to the direction of rotation of the impeller 4. The flow rate of the stream $Q_1$ returning to the circulating pipe 3 is dependent on the cross-sectional area of the annular gap 11, the direction of the stream being determined, by the slope of the vanes 12. The cross-sectional area of the gap 11 and the slope of the vanes 12 have been chosen so as to swirl the pulp in the circulating pipe 3 in the direction opposite to the rotation of the impeller 4. In such a case, the pulp above the impeller 4 forms a cone rotating in the direction opposite to the rotation of the impeller 4. This precludes a break in the pulp flow in the circulating pipe 3 above the impeller 4, which in turn permits the pulp to be vigorously agitated by its continuous axial flow in the agitation zone of the flotation cell 1. The boundaries of the agitation zone correspond approximately to those of zone A in FIG. 1.

The pulp stream $Q_2$ rises to the upper portion of the flotation cell 1, i.e. to the flotation zone whose boundaries correspond approximately to those of zone B, and returns through the holes 13 to the interior of the circulating pipe 3.

The rotating pulp cone which is formed in the circulating pipe 3 entraps the atmospheric air from the circulating pipe 3. FIG. 1 shows the atmospheric air entering the circulating pipe 3 by a dashed arrow. The air arriving with the pulp flow at the impeller 4 is dispersed between the impeller blades 5. The impeller 4 has a relatively small diameter but rotates at a high speed because it is an axial-type impeller, in which the increase in its rotational speed causes no cavitation and becomes a countercurrent cone formed above the impeller 4 precludes a flow break. The high rotational speed of the impeller 4 provides for efficient dispersion of the air contained in the pulp by producing many small air bubbles with a large total surface area. Aerated pulp is agitated in the agitation zone A with the result that particles of the material to be floated stick to air bubbles which come to the pulp surface and transport said particles, thus improving the machine output. Air bubbles with particles of the material to be floated gather on the pulp surface to form a froth product rich in the material to be floated. The froth product is removed from the flotation cell 1 through the overflow lip 2 and passes to further treatment.

Additionally, the high rotational speed of the impeller 4 enables the shaft of the electric motor 7 to be connected directly to the shaft 6 of the impeller 4 without using an intermediate reduction gear.

Since the gap 11 of the guide means 8 is disposed in the lower portion (in the agitation zone A) of the flotation cell 1, the flow $Q_1$ causes no or practically no turbulence (agitation) in the flotation zone B. The surface area of the holes 13 is chosen small so that the flow $Q_2$ is only a small part of the flow chart Q, i.e. small as compared to the flow $Q_1$, thus causing no considerable agitation of the pulp in the flotation zone B. This lowers the probability that solid particles of the material being floated to be torn off from air bubbles, thus raising the machine output, and lowers the probability that particles of the material not be floated, e.g. gangue, are carried by turbulent currents to the flotation zone B, thus improving the quality of the concentrate obtained. The flow $Q_2$ accelerates the movement of air bubbles with particles of the material to be floated towards the pulp surface, thus raising the machine output. However, excessive increase in the flow $Q_2$ increases excessively the number of particles not to be floated getting to the pulp surface, thus impairing considerably the quality of the concentrate obtained. Therefore, the surface area of the holes 13 is chosen so as to provide a maximum machine output without impairing considerably the quality of the concentrate obtained.

The flotation process may also be carried out without vertical agitation of pulp, i.e. in the case where the flow $Q_2$ is zero, the air bubbles with solid particles of the material to be floated being only transported by the action of the air bubbles' own lift. Such a flotation process will take place when using a circulating pipe 3 having a continuous wall, i.e. without holes 13. This lowers somewhat the machine output but provides for a high-quality concentrate.

When using a circulating pipe 3 with holes 13 provided in its side wall, the flow $Q_2$ passing through said holes forms pulp jets falling from the holes 13 on the surface of a cone formed by the pulp rotating in the circulating pipe 3. As a result, disturbances arise on the surface of the cone which aids in more efficient entrapment of the air by the pulp. Additionally, the jets entrap the air themselves when falling and thus improving the efficiency of the pulp aeration process. This implementation of the aeration process in a flotation machine generally makes it possible to dispense with an external source for forced air supply and hence with additional equipment. Moreover, sufficient aeration of pulp is often ensured also by using the circulating pipe 3 having a continuous wall, i.e. having no holes 13.

Due to the baffles 14 arranged above the holes 13 and directed opposite to the slope of the impeller blades 5, the pulp jets issuing from the holes 13 assume the direction of motion opposite to the rotation of the impeller 4, which increases the rotational speed of the countercurrent cone in the circulating pipe 3 and lowers somewhat power requirements.

Pulp aeration is further carried out by means of a sparger 15 (FIG. 3) as may be required. The air from an external source (not shown) is fed through the pipe 19 via the connection 18 to the inside of the hollow torus 16 and directed through the slots 17 to the space below the impeller 4 (FIG. 1) and further to the flotation zone B. The slope of the slots 17 which is opposite to that of the impeller blades 5 makes for efficient aeration of pulp. Additionally, said slope of the slots 17 in the hollow torus is beneficial for preventing rotary motion of the pulp issuing from below the impeller 4 and improves dispersion of the air arriving through the sparger 15 thanks to generation of opposing pulp and air currents. It is generally possible to dispense with an external source for air supply, as stated above. In such cases, it is not required to install a sparger 15.

The preferred embodiment of the invention described above is only an example illustrating the essential features of the invention. It is to be understood that various modifications of the embodiment described are possible which, however, do not go beyond the scope of the invention as defined by the claims listed below.

What is claimed is:

1. A mechanical flotation machine adapted for obtaining from a pulp containing material to be floated a product enriched in said material, comprising:

a flotation cell adapted for receiving said pulp, having a bottom, an upper portion and a lower portion and provided with an overflow lip in said upper portion, said lip serving to discharge said product therethrough;

a vertically arranged circulating pipe installed in said flotation cell, said pipe extending vertically from its top to bottom relative to said cell and having a side wall, an upper end disposed above said overflow lip and a lower end disposed in said lower portion of the flotation cell;

an axial flow impeller rotatable about a vertical axis of rotation between said lower end of said circulating pipe and said bottom of said flotation cell, having an upper inlet side above said impeller and a lower outlet side below said impeller, said impeller provided with blades extending radially inwardly from outer points toward the axis of rotation and inclined with respect to a plane in which said blades rotate, said impeller facing the lower end of said circulating pipe with its inlet side for movement of said pulp from the interior of said circulating pipe to the space at the outlet side of said impeller;

a drive means adapted to set said impeller in rotary motion;

a means communicating the space at the outlet side of said impeller with the interior of said circulating pipe, said means comprising an outer hollow cylinder having an upper end and a lower end installed below the lower end of said circulating pipe and secured by its upper end to the lower end of said circulating pipe, an inner hollow cylinder having an upper end and a lower end, said inner cylinder being concentrically located radially inward of said outer hollow cylinder thereby defining an annular gap therebetween, said inner cylinder enclosing said impeller, and vanes radially arranged in said annular gap and inclined to the axis of rotation of said impeller in the direction opposite to the slope of the impeller blades to direct the pulp flow from the space below said impeller to the interior of said circulating pipe in the direction opposite to that of rotation of said impeller.

2. A mechanical flotation machine as claimed in claim 1, wherein said means communicating the space at the outlet side of said impeller with the interior of said circulating pipe additionally comprises holes provided in the side wall of said circulating pipe and furnished with baffles mounted above said holes inside said circulating pipe to direct the pulp to the interior of said circulating pipe in the direction of said lower end of said circulating pipe.

3. A mechanical flotation machine as claimed in claim 2, wherein said baffles are inclined relative to the axis of rotation of said impeller in the direction opposite to the slope of the impeller blades so as to direct the pulp in the direction opposite to the rotation direction of said impeller.

4. A mechanical flotation machine as claimed in claim 1, and further comprising a hollow torus having an inner surface and an outer surface, installed below said impeller, secured to the lower end of said inner hollow cylinder, said inner surface including slots inclined relative to the axis of rotation in the direction opposite to the slope of said impeller blades, and a means for supplying air under pressure through said slots to the space below said impeller.

* * * * *